United States Patent [19]

Charron

[11] Patent Number: 4,460,349

[45] Date of Patent: Jul. 17, 1984

[54] PAPERBOARD TRAY FORMING MACHINE

[75] Inventor: William Charron, Fremont, Calif.

[73] Assignee: Manville Service Corporation, Denver, Colo.

[21] Appl. No.: 371,851

[22] Filed: Apr. 26, 1982

[51] Int. Cl.[3] ..... B31B 3/02

[52] U.S. Cl. ..... 493/163; 493/142; 493/131; 493/177; 493/178

[58] Field of Search ..... 493/163, 142, 144, 177, 493/178, 182, 180, 175, 319, 132, 131, 130, 151

[56] References Cited

U.S. PATENT DOCUMENTS

| | | | |
|---|---|---|---|
| 732,703 | 7/1903 | Brown . | |
| 2,116,995 | 5/1938 | Bickford | 93/3 |
| 2,171,418 | 8/1939 | Palmer | 493/163 X |
| 2,299,474 | 10/1942 | Evans | 93/3 |
| 2,340,678 | 2/1944 | Milmoe | 226/2 |
| 2,430,878 | 11/1947 | Kimball | 226/14 |
| 2,651,898 | 9/1953 | Kimball | 53/91 |
| 2,873,565 | 2/1959 | Arneson | 53/29 |
| 3,004,478 | 10/1961 | Phin | 493/163 |
| 3,461,642 | 8/1969 | Langen et al. | 53/29 |
| 3,832,826 | 9/1974 | Ullman | 53/35 |

*Primary Examiner*—James F. Coan

*Attorney, Agent, or Firm*—Ronald M. Halvorsen; John D. Lister

[57] ABSTRACT

A paperboard tray forming machine is disclosed which is designed for forming a paperboard tray from a flat production blank. The paperboard tray has front and rear end panels hingedly attached to side panels by means of folded gusset corner panels. The tray further has folded over corner flaps hingedly attached to the gusset panels and upwardly turned top flaps hingedly attached to the front and rear end panels. The machine is formed in a plurality of stations designed to take a paperboard flat production blank from a hopper and to fold the tray into the finished shape through a series of folding and glueing stations in the machine. The path of travel through the machine is in a generally U-shape. The various folding and glueing stations are positioned around an endless traveling conveyor having a plurality of mandrels attached thereto. The carton blank advances first in one direction and then turns in a U-shaped path and advances in the opposite direction. The folded carton is then stripped from the mandrel to be passed to a filling station forming no part of the invention.

10 Claims, 17 Drawing Figures

Fig. 8.
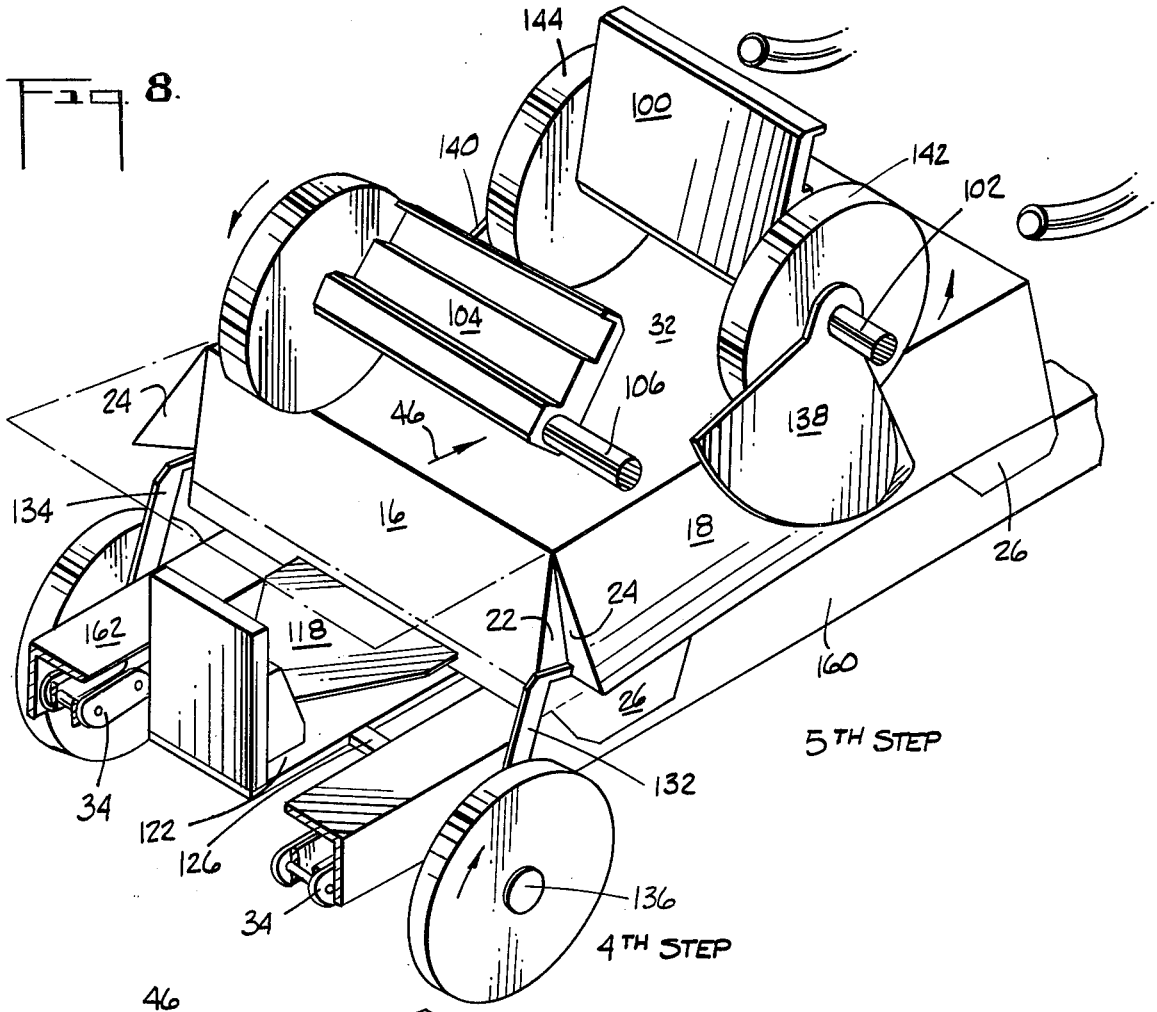
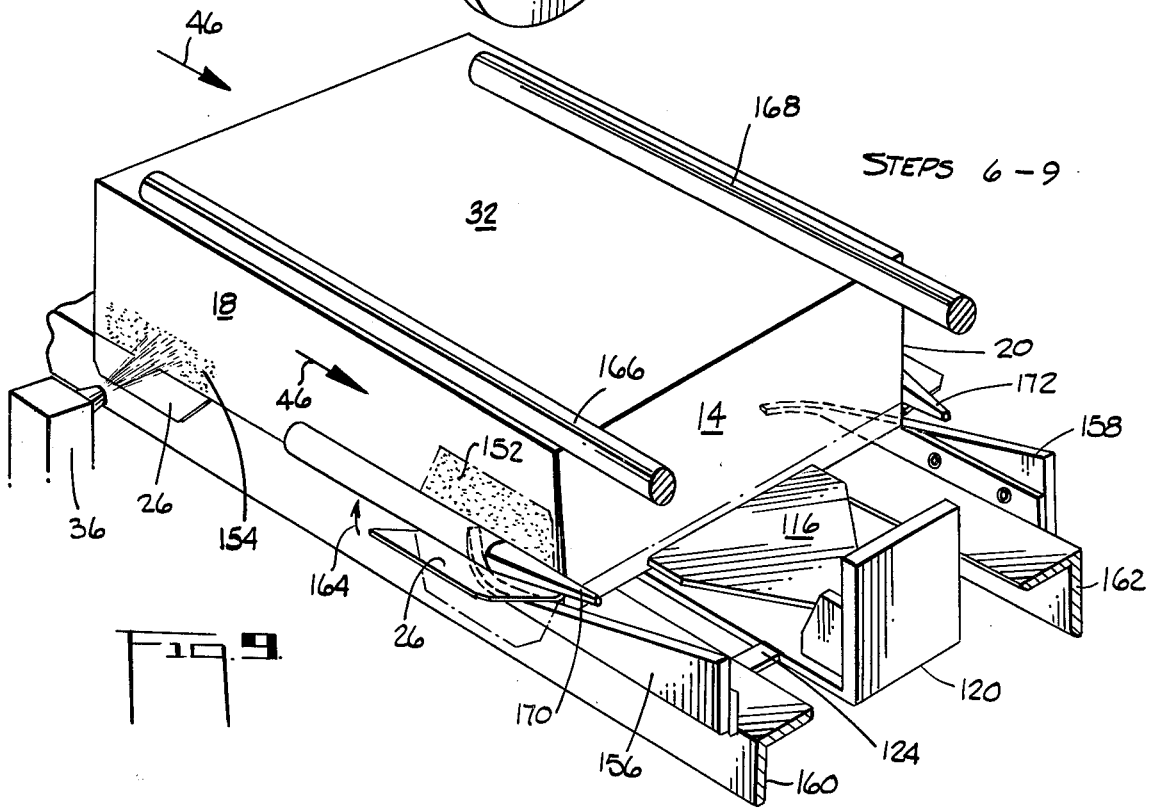
Fig. 9.

PAPERBOARD TRAY FORMING MACHINE

BACKGROUND OF THE INVENTION

In the formation of paperboard trays of the type formed on the Applicant's machine, it is desirable to provide a machine having high speed capabilities and efficient operations in the various stations of the machine. It is also desirous to provide a machine having a short total length which can then be more easily fitted into a food processor's packaging line without undue cost to the processor. It is also desirable to be able to fold the paperboard tray at the respective fold lines in a proper sequence and also to apply proper amounts of glue at pre-determined surfaces in the machine process. When the glue is applied it is desirable to hold the glued portion of the paperboard tray for a short pre-determined length of time in order to allow the glue to set.

Previous paperboard tray forming machines have been designed for specific applications of specific trays and the Applicant's invention overcomes many of the problems encountered using prior art machinery which would not be adaptable to the particular style of tray for which the Applicant's machine is designed and would not be applicable for the particular food processor's installation.

SUMMARY OF THE INVENTION

In order to overcome the problems inherent in prior art tray forming machines as applied to a particular tray and field operation, there has been provided by the subject invention a new and improved tray forming machine which is designed to take a flat production blank of a paperboard tray and to form the blank to a finished tray which is suitable for passing to a filling station. The Applicant's tray for which the subject machine was designed comprises a paperboard tray having front and rear end panels which are hingedly attached to side panels by means of folded gusset corner panels. The tray further has folded over corner flaps which are hingedly attached to gusset panels with upwardly turned top flaps hingedly attached to the front and rear end panels.

The Applicant's new and improved tray forming machine is formed in a generally U-shaped configuration, horizontally positioned such that a plurality of the paperboard production blanks may be drawn from a tray feeder and may be formed on endless traveling mandrels which are attached to an endless conveyor. A plurality of in-line stations thereupon perform the various folding and gluing operations to the paperboard tray. The direction of the movement of the tray in the machine is reversed through the general U-shaped configuration and the tray is released from the mandrel onto a second in-line moving conveyor formed in the food processor's filling line. The filling operation forms no part of the Applicant's invention. While the folded paperboard tray is moving along the second in-line conveyor, there is also provided in the Applicant's machine means for pre-breaking the upwardly turned top flaps in the carton to a pre-determined position which permits a lid to be later positioned over the tray after it has been filled.

BRIEF DESCRIPTION OF THE DRAWINGS

FIG. 8 is a perspective view of the Applicant's machine showing the next step in the folding operation with a second means for folding being shown to fold the side panels of the carton downwardly while a second pair of gusset influencers are shown for influencing the rear gussets of the paperboard tray prior to the sides being folded downwardly;

FIG. 9 is a perspective view showing the next step in the operation of the Applicant's machine which would be the application of hot melt to the front and rear corners of the paperboard tray whereupon a series of plows are utilized to move the downwardly depending corner flaps to turn them outwardly and upwardly into a glued position;

DESCRIPTION OF THE PREFERRED EMBODIMENT

Figure 1:
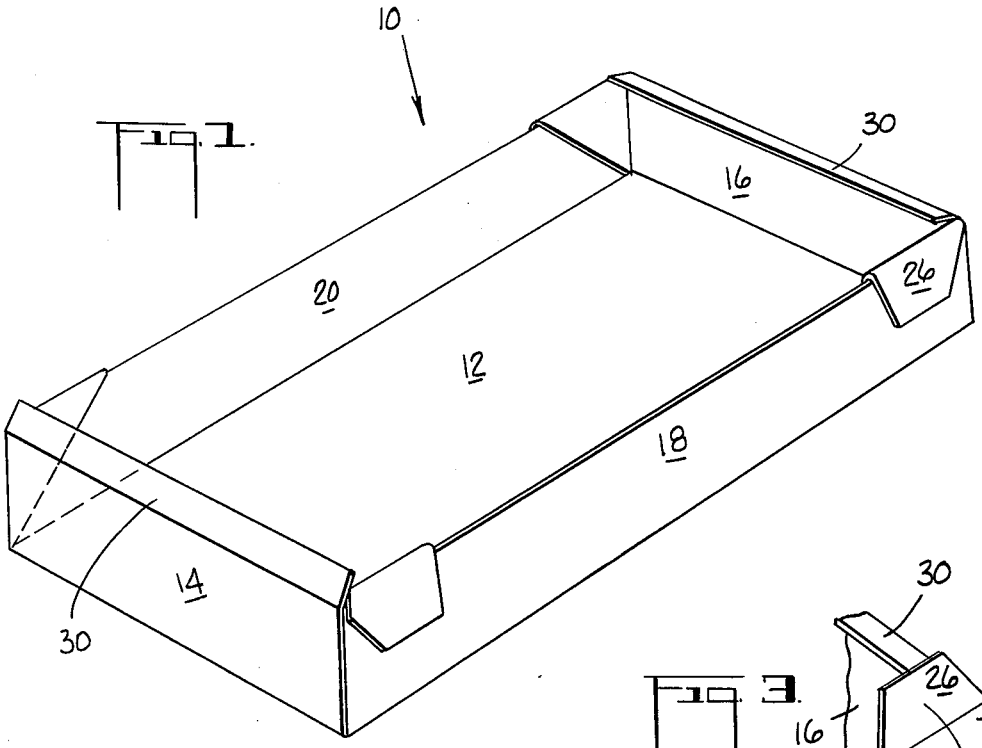
FIG. 1 is a perspective view of the type of paperboard tray which is folded by the Applicant's new and novel machine.
Figure 3:
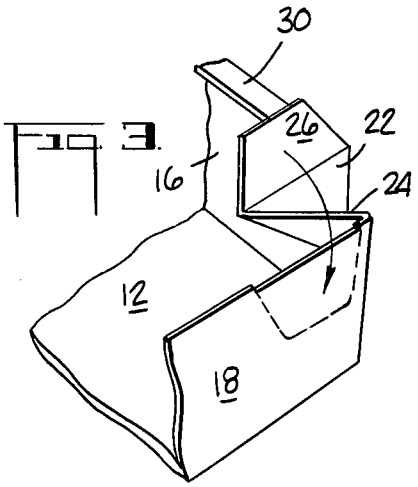
FIG. 3 is a partial sectional perspective view showing a corner of the tray formed in the Applicant's machine with the before-mentioned folded corner gusset panels and the folded over corner flaps hingedly attached to the gusset panels.
Figure 2:
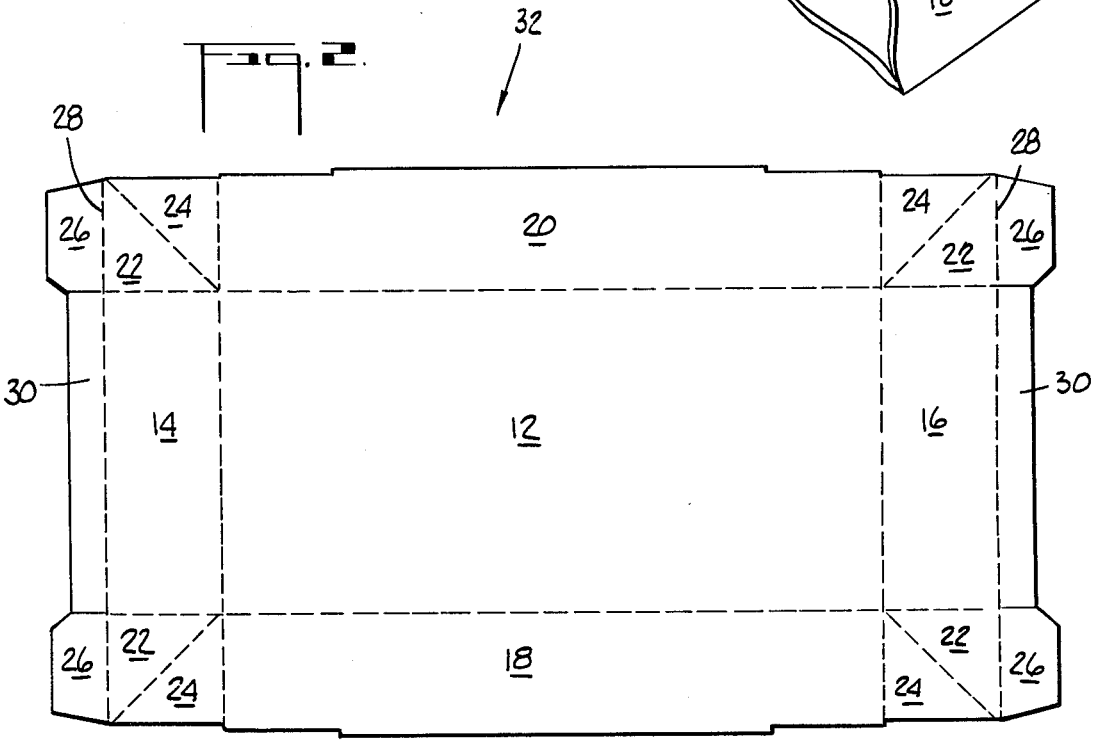
FIG. 2 is a plan view of the production blank of the tray shown in FIG. 1.

Referring now to FIGS. 1–3 of the drawings in general, there is shown the type of new and improved paperboard tray shown generally by the numeral 10 of the type for which the Applicant's machine is designed to set up. The tray 10 comprises a bottom panel 12 having front and rear end panels 14 and 16 hingedly attached to side panels 18 and 20 and to the bottom panel 12. Folded corner gusset panels 22 and 24 are hingedly attached to each side and end panel as is known in the art and one of the gusset panels 22 has formed thereon corner flap 26 which is hingedly attached to the gusset panel 22 by means of the score line 28.

An upwardly turned top flap 30 is hingedly attached to the front end panel 14 and the rear end panel 16 by means of the score line 28 and is designed to seal against a top lid which later is placed over the erected tray to prevent the product from slopping over the front or rear of the tray. The remaining dashed lines shown in FIG. 2 of the drawing indicate score lines as is known in the art and are used to allow the production blank shown generally by the numeral 32 to be easily folded to the desired position. By referring to FIGS. 2 and 3 in combination with FIG. 1, it can be readily seen how each of the various panels and flaps are folded to provide the erected carton shown in FIG. 1 of the drawing. The Applicant's new and improved tray forming machine is then directed to forming the tray in the manner shown in FIG. 1 through the various forming stations which will hereinafter be described.

Figure 4:
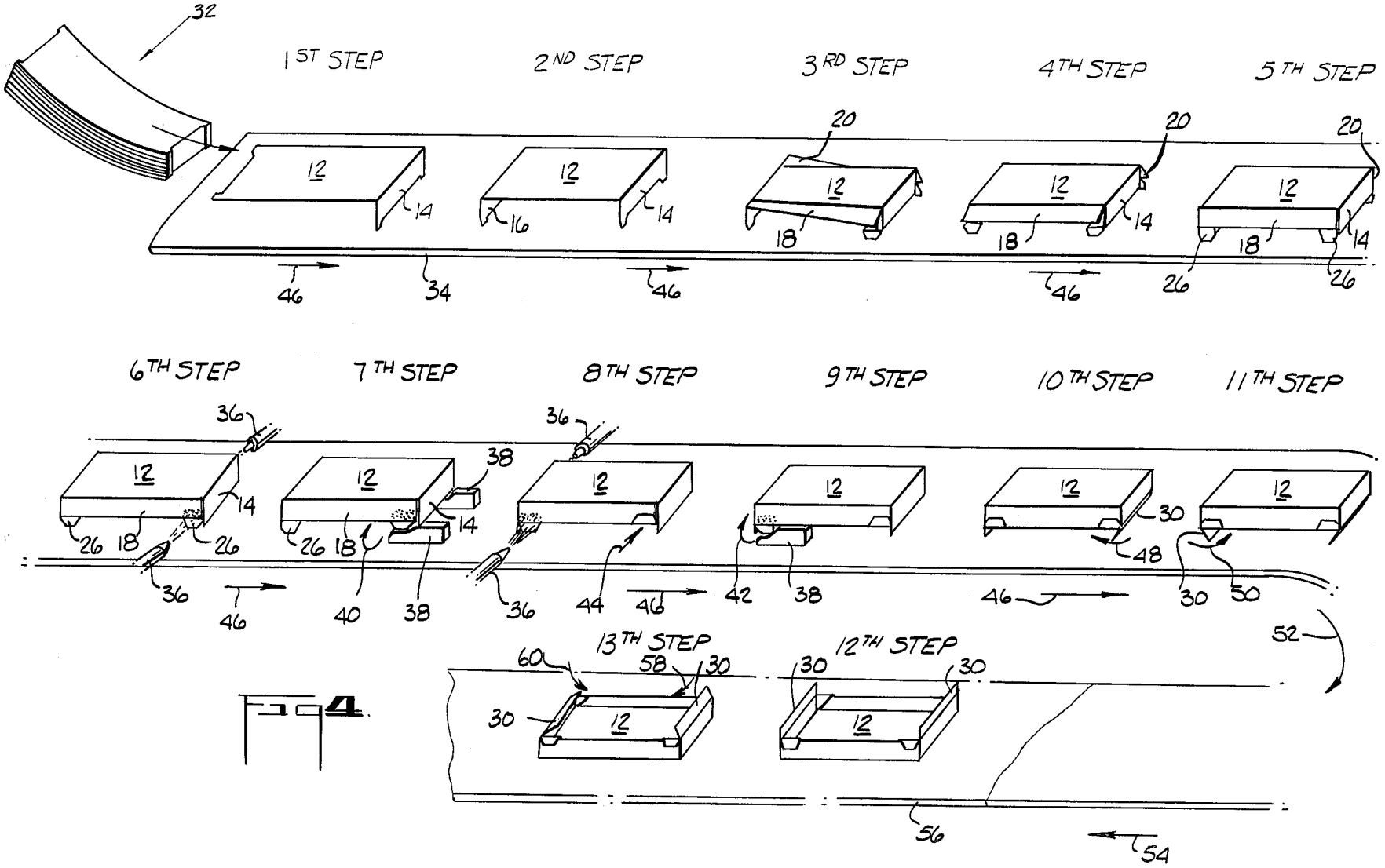
FIG. 4 is a diagrammatic view of the various folding sequences for folding the paperboard tray shown in FIGS. 1–3.

Referring now to FIG. 4 of the drawing, there is shown a diagrammatic of the Applicant's new and improved tray forming machine showing the steps through which the various panels and flaps are folded in the erection of the carton. A plurality of paperboard blanks 32 are removed from a feeder hopper and are positioned over a plurality of endless traveling mandrels which are fixedly attached to an endless conveyor 34. In the first step in the erection sequence on the Applicant's machine, the front end panel 14 is folded downwardly from the bottom panel 12. Thereafter in the second step, the rear end panel 16 is folded downwardly in a manner similar to the folding of the front end panel 14. The third step in the folding sequence is to influence the gusset panels 22 and 24 on the front of the carton in proximity to the front end panel 14 so that they assume their proper inwardly folded position inwardly of the folded tray. The fourth step in the folding sequence then is to influence the rear gusset panels 22 and 24 in proximity to the rear end panels 16 in a manner similar to the manner previously obtained in influencing the front gusset panels.

In the fifth step of the Applicant's new and novel tray forming machine, the side panels 18 and 20 are then folded downwardly so that the carton at this position in the machine appears in a downwardly positioned open rectangular configuration having four corner flaps 26 facing downwardly in the direction of the endless conveyor 34. In the sixth step, a pre-determined quantity of adhesive is sprayed on the front portion of the side panels 18 and 20 by means of adhesive guns 36 positioned on each side of the traveling tray. In the seventh step, a pair of plows 38, positioned on each side of the front end panel 14, are used to plow the corner flaps 26 upwardly and outwardly in the direction shown by the arrow 40.

In the eighth step, a pre-determined quantity of adhesive is applied to the rear corner flaps 26 by means of the adhesive guns 36 and in the ninth step the plows 38 are used to position the rear corner flaps 26 upwardly and outwardly as shown by the arrow direction 42. During the application of the adhesive by means of the adhesive guns 36 and the plowing of the corner flaps 26 by means of the plows 38, an endless conveyor belt is utilized to hold the previously positioned corner flaps 26 in their glued position until the adhesive sets. This is shown diagrammatically in FIG. 4 by the use of the arrow 44 representing an inward force applied by the endless conveyor which will be described hereinafter to hold the corner flaps 26 against the previously applied adhesive. During the travel of the production blank 32 through the Applicant's new and improved machine, the endless coveyor 34 will be traveling in the direction shown by the arrow 46. It will be understood that the steps 1–11 referenced herein when referring to FIG. 4 all take place on top of the conveyor 34 and it should be understood that several of the steps are combined in one area of the machine which will be shown hereinafter when referring to later figures of the drawings. The diagrammatic reference of FIG. 4 is shown for purposes of clarity in order to understand how the various panels and flaps are folded and glued in order to more fully understand the Applicant's new and novel machine.

Referring back to FIG. 4, in the tenth step the front top flap 30 is pre-broken inwardly as will be described more fully hereinafter and is positioned in the direction shown by the arrow 48 while in the eleventh step the rear top flap 30 is pre-broken inwardly in the direction shown by the arrow 50. Thereafter the entire carton is now in a position to have its direction reversed 180° as shown by the arrow 52 whereupon it now travels in the reverse direction shown by the arrow 54 when it is released from the beforedescribed mandrel. In the twelfth step the carton is dropped onto a second in-line conveyor 56 which carries the package to the food filling section of the customer's food line. While on the conveyor 56, the front and rear top flaps 30 are pre-broken by a second means and positioned inwardly as shown by the arrow direction 58 and 60 to a pre-determined angle internally of the tray.

Figure 5:
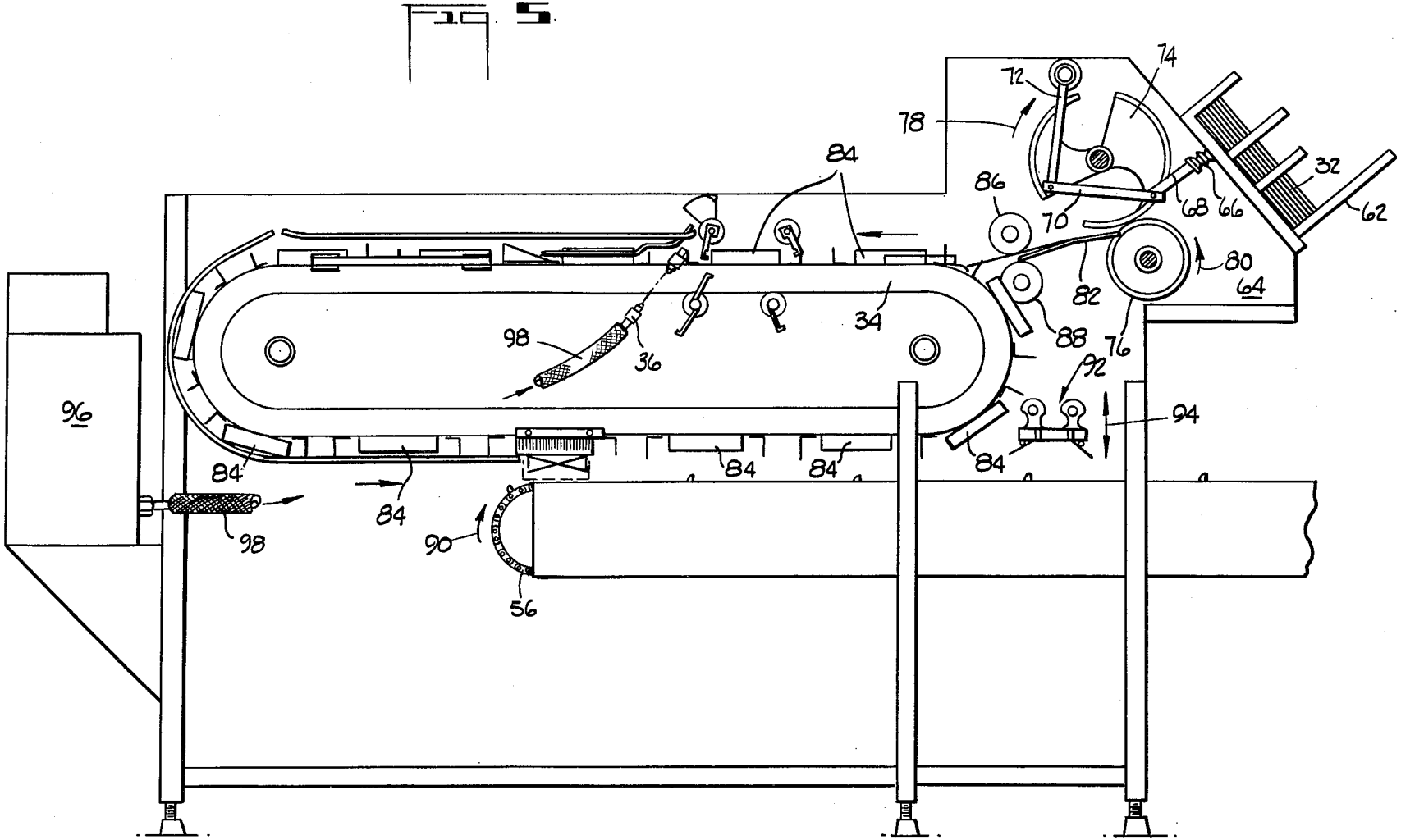
FIG. 5 is a side schematic type view showing the Applicant's new and novel folding machine and showing the various elements of the folding machine in the sequence shown in FIG. 4.

Referring now to FIG. 5 of the drawings, there is shown in greater detail, by means of a cross sectional view, the Applicant's new and novel machine showing the various steps hereindescribed. It should be noted in FIG. 5 that the cross sectional view taken through the Applicant's machine is shown in the reverse direction than that shown in the diagrammatic of FIG. 4 and this is done for purposes of clarity in order to try to visually understand where each of the parts of the machine fit together and how they inter-relate to each other so that later on when looking in still greater detail at the Applicant's machine, the various steps and parts will not be confused in the reader's mind.

As has been beforementioned, a hopper 62 is mounted on a frame 64 for containing a plurality of production blanks 32. The production blanks 32 are withdrawn from the bottom of the hopper by means of a suction cup 66 attached to an arm 68 and to the arms 70 and 72 by means known in the art. A segmental drive wheel 74 is positioned above a circular drive wheel 76 to catch the paperboard blank as it is removed from the hopper 62. The segmental drive 74 is rotating in the direction shown by the arrow 78 while the circular drive wheel 76 is rotating in the direction shown by the arrow 80 to force the production blank 32 downwardly across the tray 82 onto the endless conveyor 34 having positioned thereupon a plurality of mandrels 84 as has been beforedescribed. The feeding hopper 62 and its feeding mechanism hereinbefore described is of the type known in the prior art and is utilized in combination with the other features of the Applicant's invention to form the Applicant's complete machine. A pair of guide rolls 86 and 88 guide and drive the paperboard blank 32 onto the mandrels 84 as will be seen more clearly in FIG. 6 of the drawing.

It can be seen also in FIG. 5 of the drawing how the second in-line conveyor 56 is positioned below the Applicant's tray forming machine and is designed to rotate in the direction shown by the arrow 90 so as to be in position to receive the set up and glued production blank as it is removed from the mandrels 84 which will be described more fully hereinafter when referring to FIGS. 12 and 13 of the drawings. It can also be seen more clearly in FIG. 5 how the thirteenth step of the Applicant's folding sequence is accomplished wherein the front and rear top flaps 30 are pre-broken by the pre-breaking means shown generally by the numeral 92 which is designed to move upwardly and downwardly as shown by the arrow direction 94. There can also be seen in FIG. 5 how the adhesive tank 96 would be positioned on the one end of the Applicant's tray forming machine so that the adhesive hose 98 would be able to be easily positioned in the proper position for applying adhesive to the corner flaps 26.

Figure 6:
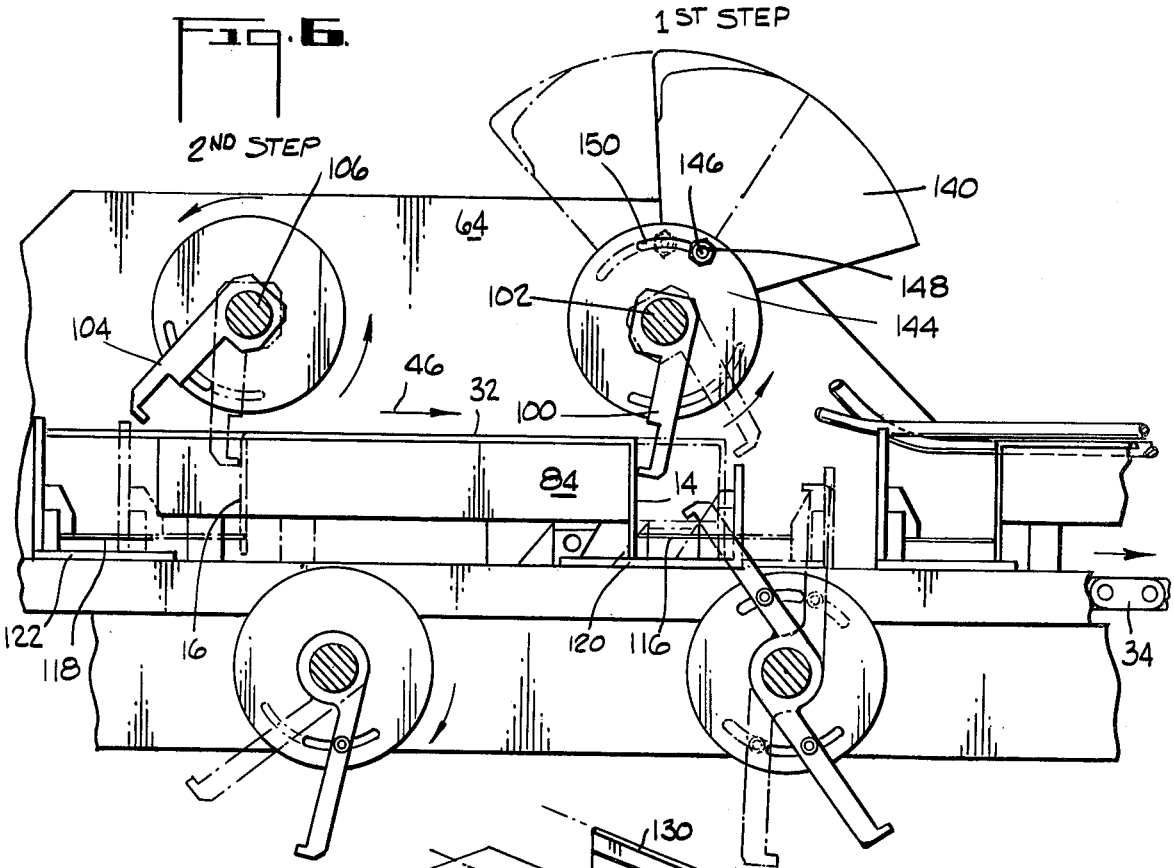
FIG. 6 is a partial side view of the first folding means described hereinafter for folding downwardly the front or leading end of the paperboard tray. Also shown in FIG. 6 is the folding down of the trailing or rear end panel of the paperboard tray.

Referring now to FIG. 6 of the drawing, there is shown the first and second steps in the folding process for the paperboard tray. The production blank 32 is moving in the direction shown by the arrow 46 having been removed from the hopper 62 as has been beforementioned and has been positioned on top of the mandrel 84. Therefore, the first means for folding the front panel downward over the mandrel comprises a rotating rectangular bar 100 which is fixedly attached to the shaft 102 and to a means for rotating the shaft not shown in the drawing. As the production blank 32 passes underneath the rotating rectangular bar 100 the rear end panel 16 is folded downwardly over the mandrel 84 by means of the second folding means in the form of another rotating rectangular bar 104 fixedly attached to the shaft 106. The shaft 106 is also attached to a means for rotating the shaft not shown in the drawing and is timed to the rotation of the shaft 102 as well as to the movement of the mandrel 84 by means of the conveyor 34 as is known in the art of mechanical timing. The shafts 102 and 106 are also carried by the frame 64 in bearings of the type known in the art also.

When the front and rear end panels 14 and 16 were folded downwardly by the rotating rectangular bars 100 and 104, a spring loaded plate 116 and 118 are used to retain the front and rear end panels 14 and 16 in their vertically downward position. The plates 116 and 118 are fixedly attached to a horizontal frame 120 and 122 which are also attached to a horizontal bar 124 and 126. The horizontal bars 124 and 126 are fixedly attached to the endless conveyor chain 34 by means well known in the art and not shown in the drawings.

Figure 7:
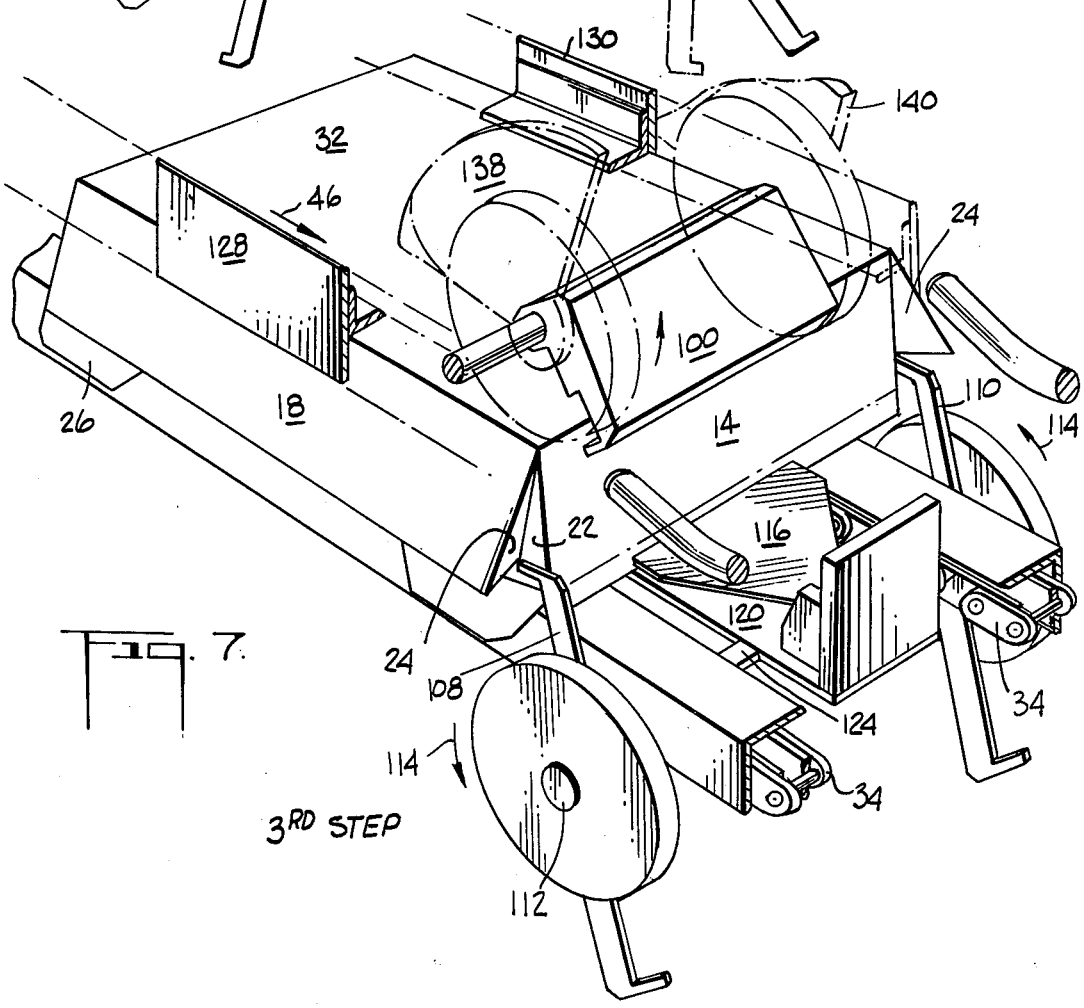
FIG. 7 is a perspective view showing the next step in the folding sequence showing a first pair of gusset influencers which are used to influence the front corner gussets of the paperboard tray so that the side panels may thereafter be folded downwardly.

By referring now to FIGS. 6 and 7, there can be seen the third step in the folding of the paperboard production blank 32 wherein a first pair of gusset influencers, in the form of rotating fingers 108 and 110, are used. The gusset influencers 108 and 110 are fixedly mounted to the shaft 112 to rotate in the direction shown by the arrow 114. The purpose of the rotating finger gusset influencers 108 and 110 is to influence or partially fold the front gusset corner panels 22 and 24 inwardly so that the side panels 18 and 20 may be next positioned downwardly by the next step in the machine process.

When the rotating fingers 108 and 110 influence the gussets 22 and 24, it will become apparent that the side panels 18 and 20 will partially be turned downwardly and a pair of channels 128 and 130 are then utilized to hold the side panels 18 and 20 in their partially downwardly turned position. The side channels 128 and 130 are fixedly attached to the frame 64 by means known in the art and not shown in the drawing.

Referring now to FIG. 8 of the drawing, there is shown the fourth and fifth step in the folding process whereby a second pair of gusset influencers, in the form of a pair of rotating fingers 132 and 134, are fixedly attached to the shaft 136 and are used to influence the rear gusset corner panels 22 and 24 to position them inwardly as shown so that the side panels 18 and 20 may be folded downwardly in the next step. As has been beforementioned, it can be seen in FIG. 8 how the spring loaded plate 118 attached to the frame 122 is used to hold the previously positioned rear end panel 16 in its vertically downward position.

In the fifth step of folding the production blank 32 into the erected tray, it can be seen how a pair of vertically positioned circular segmental plates 138 and 140, which are also fixedly attached to the shaft 102, are then used to complete the downward folding of the side panels 18 and 20 to the position shown in FIG. 8. The circular segmental plates 138 and 140 are positioned adjacent to a pair of circular plates 142 and 144 which are fixedly attached to the shaft 102. A threaded stud 146, shown in FIG. 6, is positioned in a arcuate slot 150 and is tightly held in position by a threaded nut 148. In this manner, it can be seen how the circular segmental plates 138 and 140 may be rotated through the length of the arcuate slot 150 in order to properly time the circular segmental plates 138 and 140 moving downwardly and folding the side panels 18 and 20 into their vertical position.

Referring to FIG. 9 of the drawing, there can be seen the steps 6 through 9 which consist generally of the application of hot melt to the side panels 18 and 20 and the folding of the corner flaps 26 over the side panels 18 and 20 onto the previously applied hot melt. A hot melt adhesive gun 36 is positioned on each side of the traveling package at the appropriate point in the folding process and is utilized to spray a quantity of adhesive 152 on the front portion of the side panels 18 and 20 and also to apply a pre-determined quantity of adhesive 154 on the rear portion of the side panels 18 and 20. It can be seen in FIG. 9 that the previously folded production blank 32 has had adhesive applied to the front portion of the side flaps 18 and 20 and is having a quantity of adhesive applied to the rear portion of the same flaps. It can also be seen in FIG. 9 how the front corner flap 26 is being turned upwardly by a pair of plows 156 and 158 positioned on either side of the production blank and fixedly attached to the angle 160 and 162. It can be seen by referring to FIGS. 8 and 9 how the angles 160 and 162 are used as a guide to guide the corner flaps 26 along until the plows 156 and 158 are able to plow the corner flaps upwardly in the direction shown by the arrow 164. A plurality of top rails 166 and 168 are used to hold the formed tray in the erect inverted position over the mandrel 84 and a plurality of side rails 170 and 172 are used for the same purpose of the sides.

Figure 10:
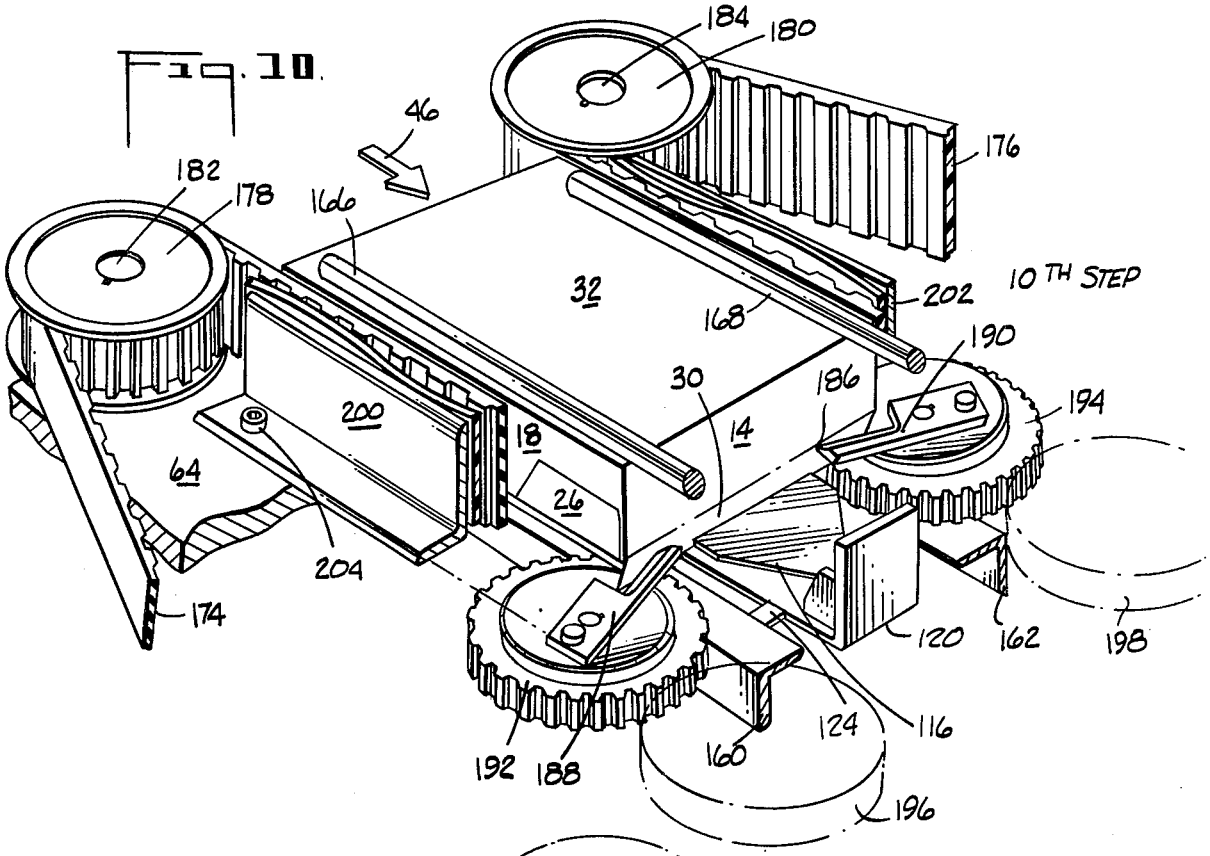
FIG. 10 is a perspective view of the next step in the Applicant's machine showing a pair of conveyor belts being utilized to hold the previously upturned corner flaps in their glued position until the hot melt, used to hold the corner flaps in place, has set. Also shown are the first means for pre-breaking the partial top flap formed on the end panels of the paperboard tray.

Referring now to FIG. 10 of the drawing, there can be seen how the previously upwardly plowed corner flaps 26 are held against the side panels 18 and 20 by means of a pair of conveyor belts 174 and 176 which are rotated around a belt pulley 178 and 180. The belt pulleys 178 and 180 are fixedly attached to the rotating vertically positioned shafts 182 and 184 and are also attached to means for rotating the shafts of the type known in the art and not shown in the drawing. The conveyor belts 174 and 176 are used to hold the upwardly turned corner flaps 26 tightly against the side panels 18 and 20 until the previously applied hot melt adhesive 152 and 154 is able to set.

It can also be seen in FIG. 10 how the tenth step of the folding sequence for the production blank 32 is obtained where a portion of the front panel is pre-broken at a pre-determined angle internally of the tray. The front panel 14 contains a top flap 30 as has been beforedescribed which is hingedly attached thereto by means of a score line 186. The first pre-breaking means comprises a pair of horizontally positioned rotating rectangular bars 188 and 190 which are fixedly attached to a plurality of gears 192 and 194 which in turn are rotatably turned by a plurality of gears 196 and 198. The gears 196 and 198 are fixedly attached to means for rotating the gears of the type known in the art and not shown in the drawing for purposes of clarity. In FIG. 10, the endless conveyor chain 34 is also not shown for purposes of clarity. In order to tightly hold the conveyor belts 174 and 176 against the upwardly turned corner flaps 26, there is provided a pair of angles 200 and 202 fixedly attached to the machine frame 64 by a plurality of bolts and nuts 204.

Figure 11:
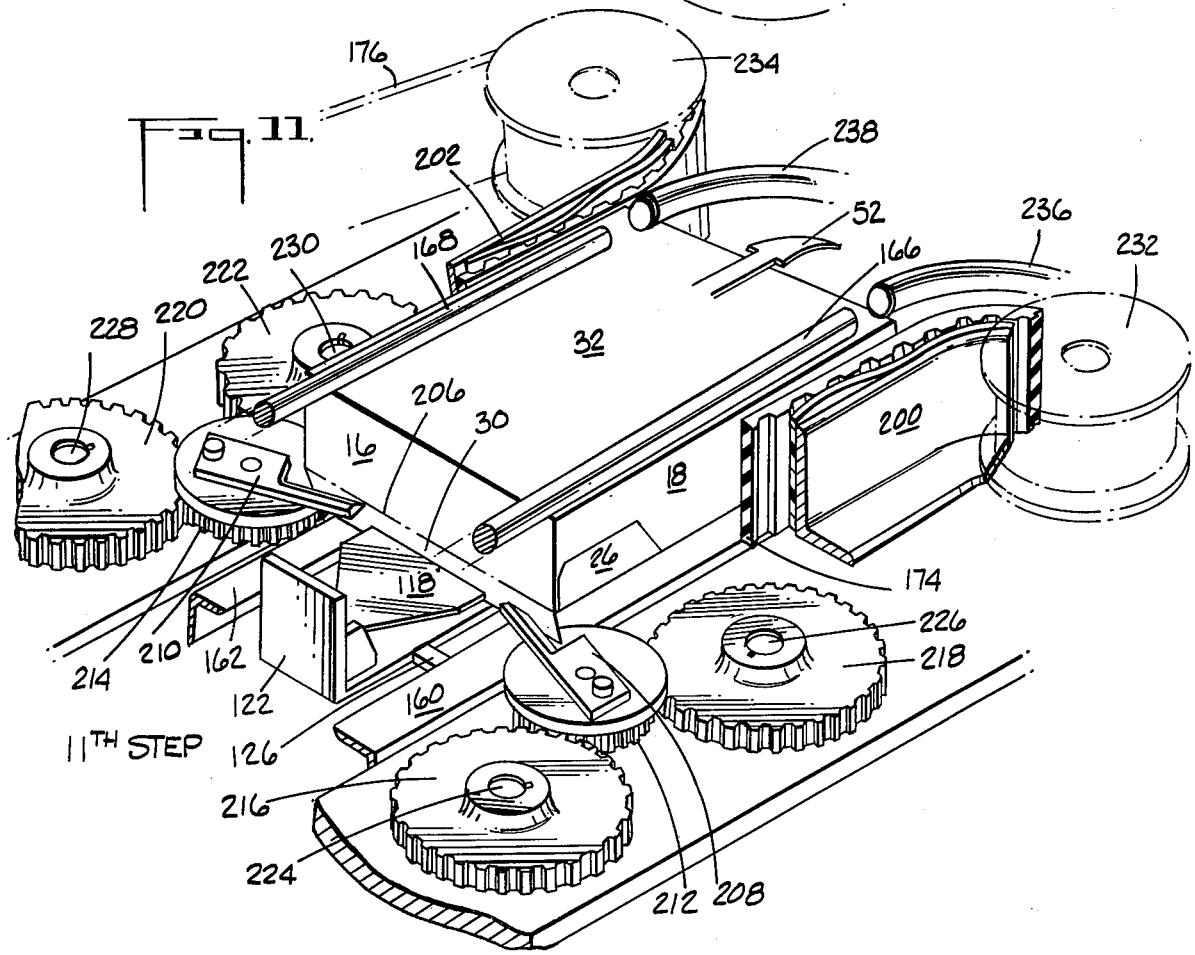
FIG. 11 is a perspective view showing the second means for pre-breaking the top flap formed on the rear panel of the paperboard tray and showing the folded paperboard tray about to be reversed in direction in the Applicant's machine.

Referring now to FIG. 11 of the drawing, there is shown the eleventh step in the folding sequence whereby the production blank 32 has its rear top flap 30 which is hingedly attached to the rear end panel 16 pre-broken so that the top flap 30 is positioned at a pre-determined angle internally of the tray. This is accomplished by a second pair of bars 208 and 210 which are fixedly attached to a rotating gear 212 and 214. The gears 212 and 214 are also rotated by means of the pair of gears 216 and 218 as well as the pair of gears 220 and 222. The gears 216 and 218 are fixedly attached to the shafts 224 and 226 while the gears 220 and 222 are fixedly attached to the shafts 228 and 230. These shafts are also attached to means for rotating the shaft of the type known in the art and not shown in the drawing.

It can be seen in FIG. 11 how the conveyor belts 174 and 176 are positioned around a pair of pulleys 232 and 234 thereby continuing to hold the upturned corner flaps 26 tightly against the side panels 18 and 20. At this point in time in the machine, the corner flaps 26 have their adhesive set sufficiently so that no further holding is required of these flaps by the conveyor belts 174 and 176. A pair of arcuate turning rails 236 and 238 are then used in combination with lower turning rails not shown in the drawing for turning the folded tray downwardly in the direction shown by the arrow 52 and reversing its direction to that shown by the arrow 54 in FIG. 12 of the drawing.

Figure 12:
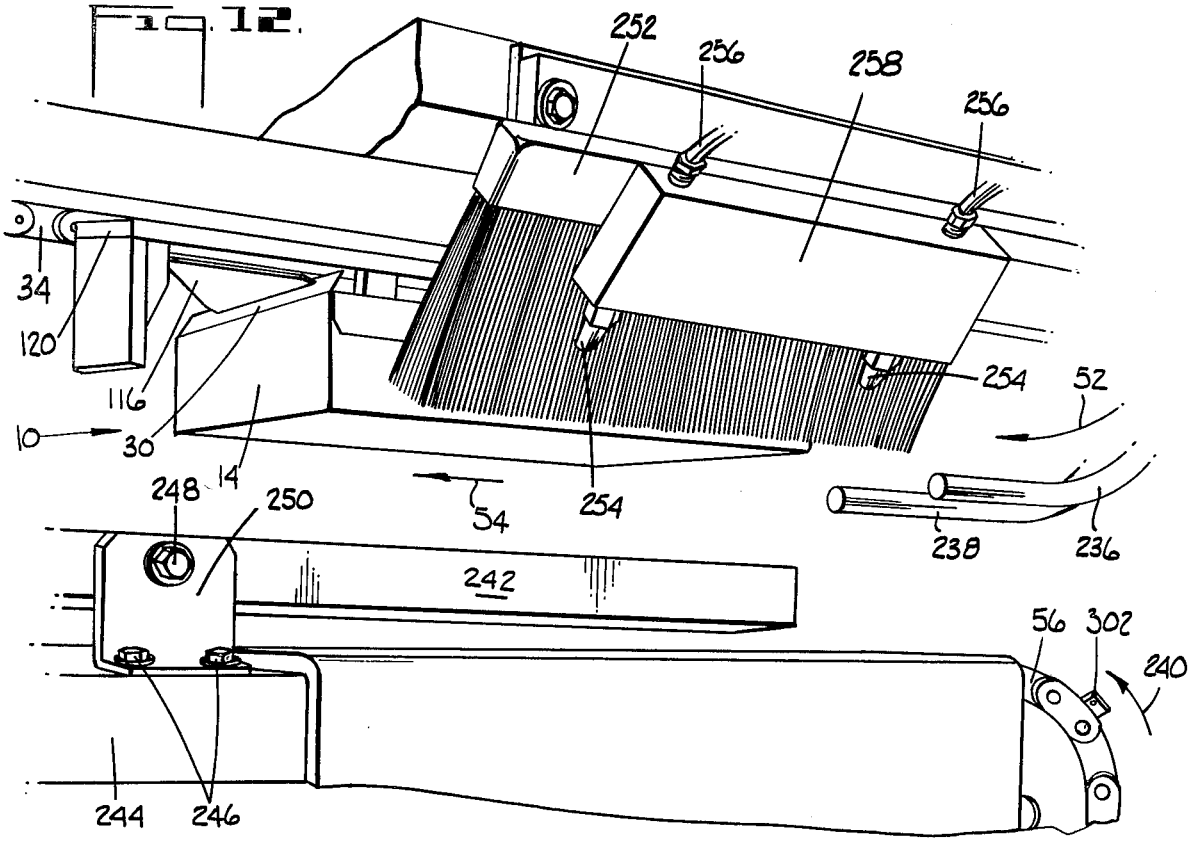
FIG. 12 is a perspective view showing the folded paperboard tray having been reversed in direction and now being upright in position and about to be released onto a second in-line conveyor from the mandrel holding the tray.

It can be seen by referring now to FIG. 12 of the drawing that the completely folded, glued and erected tray is still contained on the mandrel 84 which is now also moving in the direction 54 since the conveyor chain 34 has been reversed in direction also as can be more readily seen by referring to FIG. 5 of the drawing. A second in-line conveyor 56 moving in the direction shown by the arrow 240 is positioned immediately below the Applicant's tray forming machine and is designed to carry the formed tray after it has been removed from the mandrel onto the filling station of the food processor's filling line. A pair of side rails 242 are positioned on each side of the frame 244 and are bolted thereto by means of the bolts 246 and the bolts 248 which pass through the angle 250 to hold the side rails in place.

Referring now to FIGS. 12–15, there will be shown in detail how the formed tray 10 is removed from the mandrel 84 during the twelfth step in the folding sequence for the tray. As has been beforementioned, the tray 10 has been reversed in direction by means of the conveyor chain 34 traveling in the arcuate path shown by the arrow 52. Thereafter, the mandrel 84 connected to the endless conveyor chain 34 is traveling in the direction shown by the arrow 54 and the folded tray is in the position shown in FIG. 12 of the drawing where it is positioned around the mandrel 84. A plurality of brushes 252 are positioned on each side of the tray 10 and are inwardly inclined so as to be utilized to aid in guiding the tray 10 downwardly when it is released from the mandrel 84. In FIG. 12 of the drawing, only one brush 252 is shown for purposes of clarity and it will be understood that a similar brush is positioned on the other side of the mandrel 84. Positioned behind the brushes 252 are a plurality of air nozzles 254 directing air from an air compressor through the air compressor lines 256 into a chamber 258 positioned downwardly and inwardly in the same general direction as the brushes 256. The purpose of the air nozzles 254 is to further aid in directing the path of the tray 10 as it is ejected downwardly from the mandrel 84 so that the tray 10 is positioned between the side rails 242 on the second in-line conveyor 56.

Figure 13:
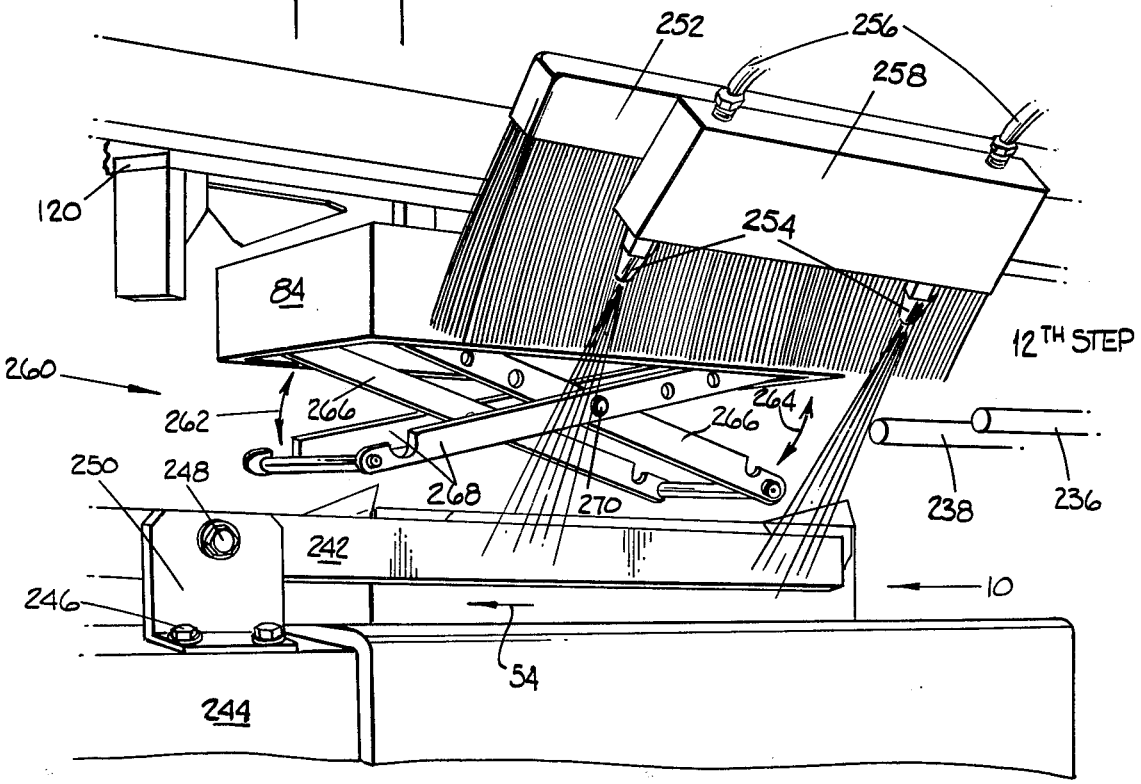
FIG. 13 is another perspective view similar to that shown in FIG. 12 showing the folded paperboard tray being released from the mandrel by operation of the scissors-like mechanism positioned within the traveling mandrel.

By referring now to FIG. 13, it can be seen how the releasing means positioned internally of the mandrel 84 is utilized to eject or release the tray 10 from the mandrel 84. The releasing means comprises a scissors mechanism shown generally by the numeral 260 which travels in the direction shown by the arrows 262 and 264. The releasing means comprises a pair of pivotably fastened arms 266 and 268, pivotably held together by means of the horizontal rod 270 positioned midway between the positioning of the arms. A similar pair of arms 266 and 268 is positioned on the other side of the mandrel 84 and the horizontal rod 270 is positioned between both sets of arms. By the use of the releasing scissors mechanism shown in FIG. 13, it can be seen how the tray 10 is removed from the mandrel 84 whenever the scissors mechanism is activated and the tray is positioned between the side rails 242 being aided in its downward journey by means of the pair of brushes 252 and the air nozzles 254 positioned within the air chamber 258.

Figure 15:
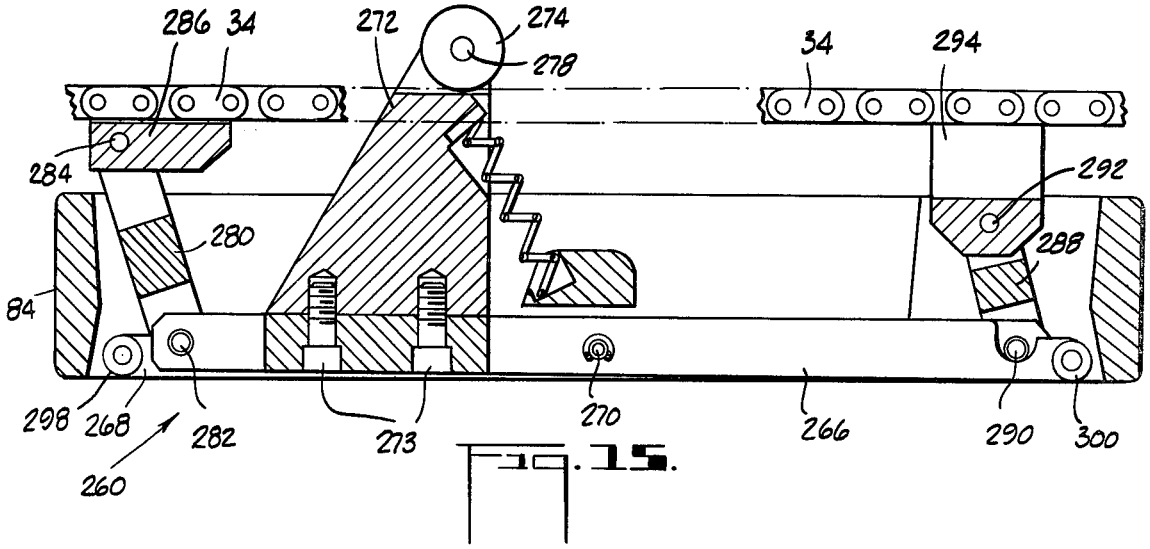
FIG. 15 is a similar longitudinal sectional view of the scissors mechanism of the traveling mandrel showing how the scissors mechanism is positioned within the mandrel when in the retracted position.
Figure 14:
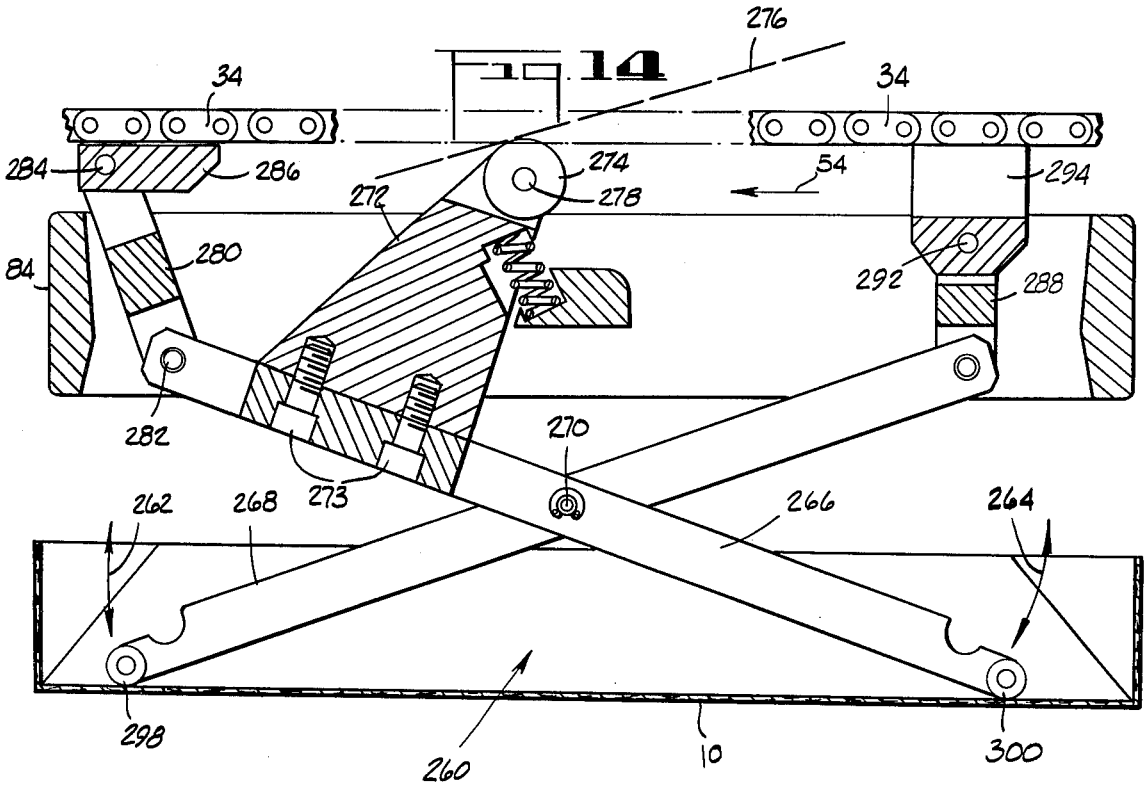
FIG. 14 is a longitudinal sectional view through the scissors mechanism of the traveling mandrel showing the operation of the mechanism and the means for activating the releasing means at a predetermined time to remove the formed tray from the mandrel.

Referring now to FIGS. 14 and 15, there will be shown simplified longitudinal views of the releasing means scissors mechanism shown in FIG. 13 of the drawing. FIG. 14 would be a longitudinal sectional view showing the scissors mechanism extended. As has been beforementioned, a pair of arms 266 and 268 are pivotably connected together by means of the horizontal rod 270. The pair of arms 266 positioned on each side of the mandrel 84 are fixedly attached to members 272 which also has rotatably mounted thereon a pair of cam followers 274 on each side of the mandrel. The members 272 are bolted to the arms 266 by means of the bolts 273. The cam followers 274 are designed to ride on the cam surface 276 which is positioned in proximity to the mandrel and serves to activate the releasing scissors mechanism at a pre-determined time in order to remove the formed tray 10 from the mandrel 84. The cam followers 274 are held on the members 276 by means of the pins 278 and are designed to allow the cam followers to rotate on the pins 278 and to ride upwardly on the inclined cam surface 276.

A connecting arm 280 is positioned on each end of the arms 266 and is pinned thereto by means of the pins 282 and is also pinned at the other end thereof by means of the pin 284 connected to the member 286. In a similar manner, a connecting arm 288 is pinned to the arms 268 by means of the pins 290 and is also pinned at the other end thereof by means of the pin 292 to the member 294.

The members 286 and 294 are fixedly attached to the endless conveyor chain 34 thereby moving the internally positioned releasing scissors mechanism of the mandrel 84 in the direction shown by the arrow 54. Prior to the releasing mechanism being activated by the cam follower 274 riding on the inclined cam surface 276, the scissors mechanism will be in the position shown in FIG. 15. Whenever the endless chain 34 moves the entire mandrel mechanism so that the cam follower 274 rides on the cam surface 276 then it can be seen how the scissors mechanism will activate and the ends 298 and 300 of the arms 268 and 266 will eject the tray 10 from the mandrel 84 downwardly in the direction shown by the arrows 262 and 264 and as shown in FIG. 13 of the drawing.

Referring now to FIG. 15 of the drawing, there is shown a longitudinal sectional view similar to FIG. 14 showing the scissors mechanism positioned within the mandrel 84 and showing the scissors mechanism before it has been activated to eject the tray 10 shown positioned over the mandrel 84. It can be seen in FIG. 15 how the rod 270 is positioned through the pair of arms 266 and 268 to carry the arms in the position shown in FIG. 15. FIG. 14 also shows the scissors mechanism after it has been activated and has been retracted into the mandrel 84. The carton 10 has not been shown in FIG. 15 for purposes of clarity.

Figure 17:
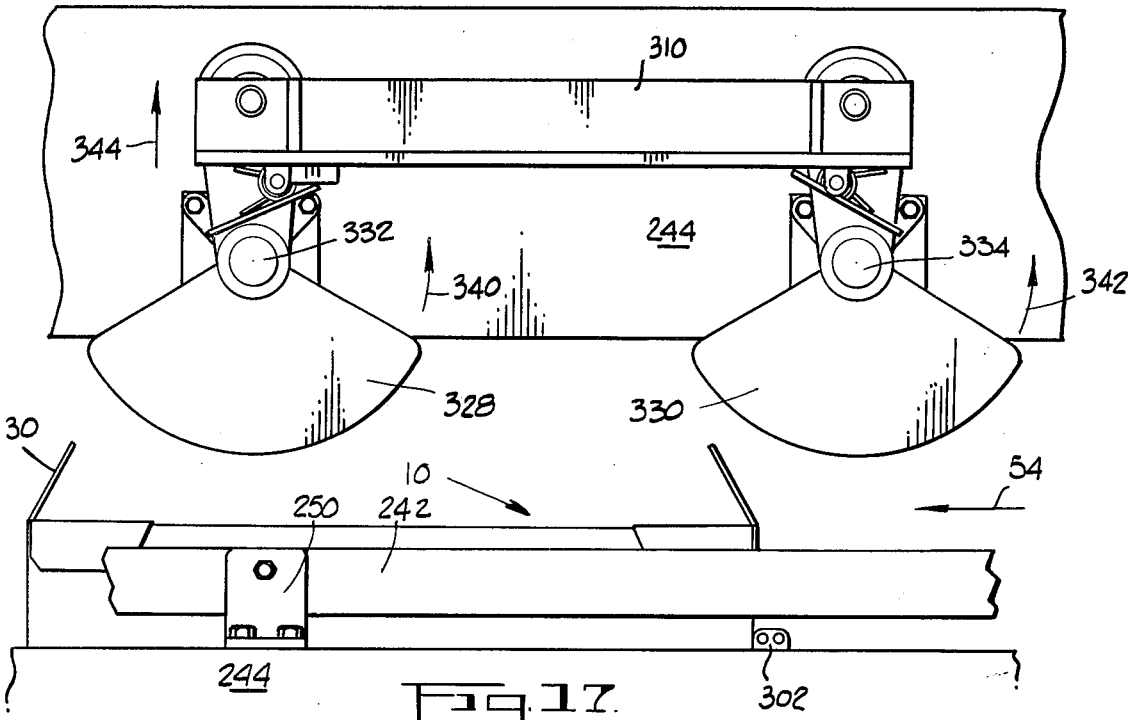
FIG. 17 is a partial side view similar to FIG. 16 showing the mechanism in operation and after pre-breaking the upwardly turned top flaps.
Figure 16:
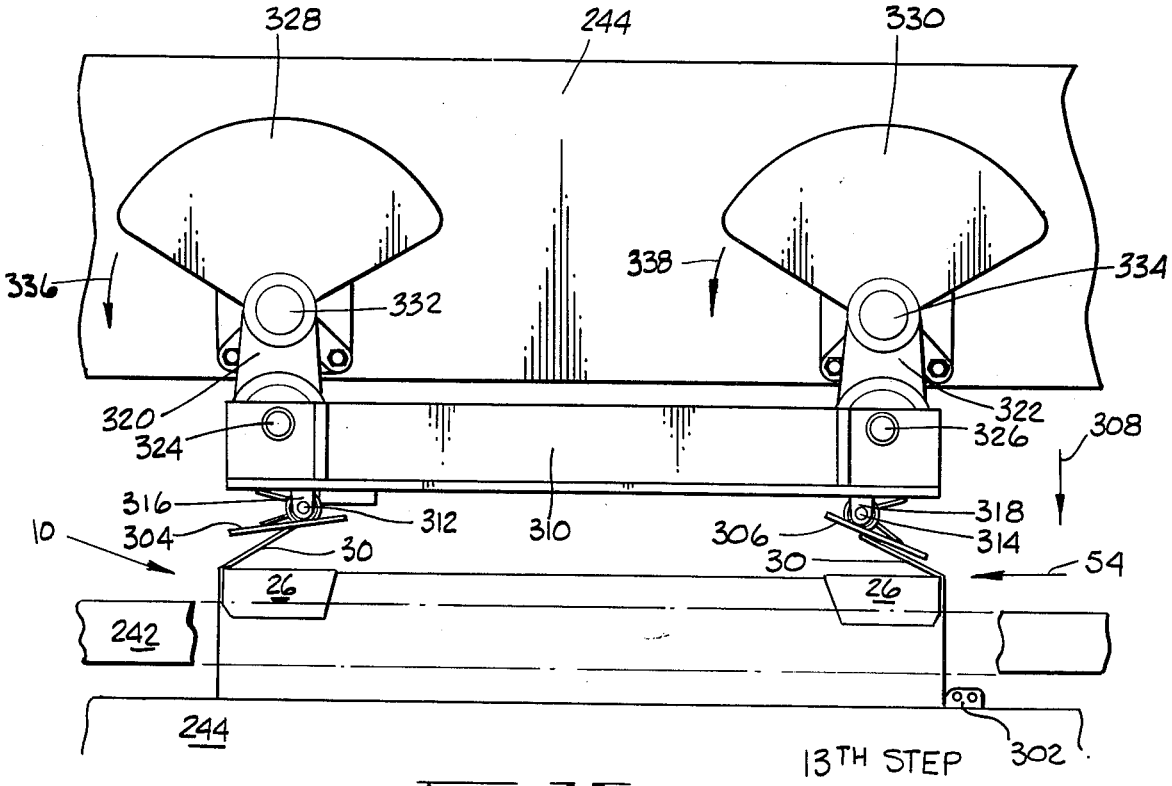
FIG. 16 is a partial side view showing the mechanism for pre-breaking the upwardly turned top flaps to a pre-determined position which permits a lid to be later positioned over the tray after it has been filled.

Referring now to FIGS. 16 and 17, there will be shown in greater detail the thirteenth and last step in the folding sequence of preparing the production blank into a folded and glued tray ready for filling by a filling station downstream of the Applicant's machine. As has been beforementioned, the erected tray 10 contains a plurality of top flaps 30 which had previously been pre-broken inwardly and now are further pre-broken so that the upwardly turned top flaps are positioned to a pre-determined position which permits a lid to be later positioned over the tray so that the top flaps 30 are tightly sprung against the underside of the lid. The tray 10 is driven along the second in-line chain conveyor 56 by means of a plurality of fingers 302 which are fixedly attached to the endless chain conveyor 56. The fingers 302 drive the tray 10 in the direction shown by the arrow 54. At the appropriate position in the Applicant's machine, a pair of folding plates 304 and 306 are moved downwardly in the direction shown by the arrow 308 to further pre-break the top flaps 30 to the exact position desired. The folding plates 304 and 306 are carried on a horizontally positioned frame 310 and are pinned thereto by means of the pivot pins 312 and 314 carried by the arms 316 and 318.

The frame 310 is also carried by a plurality of arms 320 and 322 which are pinned to the frame 310 by means of the pins 324 and 326. Counter-weights 328 and 330 are fixedly attached to rotating shafts 332 and 334 which also carry the other ends of the arms 320 and 322. The counter-weight 328 and 330 rotate in the direction shown by the arrows 336 and 338 and force the frame 310 downwardly in the direction shown by the arrow 308.

Referring to FIG. 17 of the drawing, it can be seen how the counter-weights 328 and 330 have moved in their complete downward position and are now moving upwardly in the direction shown by the arrows 340 thereby lifting the frame 310 to the upward position in the direction shown by the arrow 344. The shafts 332 and 334 that rotate the counter-weights 328 and 330 are rotated by means for rotating the various shafts contained within the machine and are timed so as to be timed with the ultimate timing of the various rotating parts in the machine using known techniques in the art. It can be seen in FIG. 17 that when the rotating counter-weights 328 and 330 are positioned as shown in the figure, the tray 10 has had its top flaps 30 positioned to the desired position and the tray is able then to be moved onto the filling portion of the packaging line by means of the pair of fingers 302 moving the tray on the conveyor.

From the foregoing, it can be seen that there has been provided by the subject invention a new and novel tray forming machine for forming from a flat production blank a paperboard tray of the type hereindescribed. It should become apparent from a review of the drawings and the description of the preferred embodiment that many changes may be made in the various parts of the Applicant's machine without departing from the spirit and scope of the invention. It should also be noted that the Applicant's invention is not to be limited to the exact embodiment shown which has been given by way of illustration only.

Having described my invention, I claim:

1. A tray forming machine for forming from a flat production blank a paperboard tray having front and rear end panels hingedly attached to side panels by means of folded gusset corner panels and further having folded over corner flaps hingedly attached to the gusset panels and upwardly turned top flaps hingedly attached to the front and rear end panels, comprising:

(a) a frame;

(b) a plurality of endless traveling mandrels carried by the frame and having releasing means positioned within the mandrels for releasing a formed tray at a pre-determined time;

(c) a sheet feeder, positioned above and in front of the traveling mandrels and attached to the frame, for feeding the flat production blank in one direction over the traveling mandrels;

(d) first means, positioned above the mandrel, for folding the front panel downward over the mandrel;

(e) second means, positioned above the mandrel for folding the rear panel downward over the mandrel as the mandrel advances;

(f) a first pair of gusset influencers, positioned on each side of the traveling mandrel, for influencing the front gusset corner panels of the traveling production blank;

(g) a second pair of gusset influencers, positioned on each side of the traveling mandrel and upstream from the first pair of gusset influencers, for influencing the rear gusset corner panels of the traveling blank;

(h) third means, positioned above the mandrel, for folding the side panels downward over the mandrel after the first and second pair of gusset influencers have influenced the front and rear gusset corner panels;

(i) a hot melt applicator, positioned on each side of the traveling mandrel for applying hot melt adhesive first to a portion of the front corner flaps and then to a portion of the rear corner flaps;

(j) a pair of plows, positioned on each side of the traveling mandrel, for turning outwardly the corner flaps and folding them against the side panels;

(k) a pair of conveyor belts positioned on each side of the traveling mandrel for holding the upwardly turned corner flaps tightly against the side panels until the previously applied hot melt adhesive has set;

(l) first means, positioned below the traveling mandrel for pre-breaking a portion of the front panel by positioning it at a pre-determined angle internally of the tray;

(m) second means, positioned below the traveling mandrel, for pre-breaking a portion of the rear panel by positioning it at a pre-determined angle internally of the tray;

(n) means, positioned in proximity to the mandrel, for activating the releasing means at a pre-determined time to remove the formed tray from the mandrel; and (o) means, positioned above the released formed tray for further pre-breaking the upwardly turned top flaps to a pre-determined position which permits a lid to be later positioned over the tray after it has been filled.

2. The tray forming machine as defined in claim 1 wherein the releasing means comprises a scissors-like mechanism attached to the outer face of each mandrel.

3. The tray forming machine as defined in claim 1 wherein the first and second folding means comprise a pair of vertically positioned rotating rectangular bars.

4. The tray forming machine as defined in claim 1 wherein the first gusset influencer comprises a pair of vertically positioned rotating fingers fixedly attached to rotating cams.

5. The tray forming machine as defined in claim 1 wherein the second gusset influencer comprises a pair of vertically positioned rotating fingers fixedly attached to rotating cams.

6. The tray forming machine as defined in claim 1 wherein the third folding means comprises a pair of vertically positioned rotating circular plates.

7. The tray forming machine as defined in claim 1 wherein the first pre-breaking means comprises a pair of horizontally positioned rotating rectangular bars.

8. The tray forming machine as defined in claim 1 wherein the second pre-breaking means comprises a pair of horizontally positioned rotating rectangular bars.

9. The tray forming machine as defined in claim 1 wherein the activating means comprises a cam positioned below the traveling mandrel and designed to activate a matching cam follower formed on the releasing means.

10. The tray forming machine as defined in claim 1 wherein the means for further pre-breaking the upwardly turned flaps comprises a pair of downwardly moving angularly positioned plates.

* * * * *